United States Patent [19]

Harandi et al.

[11] Patent Number: 4,864,067

[45] Date of Patent: Sep. 5, 1989

[54] PROCESS FOR HYDROTREATING OLEFINIC DISTILLATE

[75] Inventors: Mohsen N. Harandi, Lawrenceville; Hartley Owen, Belle Mead, both of N.J.

[73] Assignee: Mobil Oil Corporation, New York, N.Y.

[21] Appl. No.: 198,905

[22] Filed: May 26, 1988

[51] Int. Cl.[4] ..... C07C 5/00

[52] U.S. Cl. ..... 585/254; 208/143; 208/210; 208/213; 208/216 R; 585/265; 585/275

[58] Field of Search ..... 585/254, 265, 275; 208/143, 210, 213, 216

[56] References Cited

U.S. PATENT DOCUMENTS

| | | | |
|---|---|---|---|
| 3,850,743 | 11/1974 | Peiser et al. | 208/209 |
| 4,003,823 | 1/1977 | Baird et al. | 208/108 |
| 4,013,545 | 3/1977 | Hilfman | 208/143 |
| 4,115,248 | 9/1978 | Mulasky | 208/143 |
| 4,115,255 | 9/1978 | Hayes et al. | 208/143 |
| 4,126,539 | 11/1978 | Derr et al. | 208/143 |
| 4,186,080 | 1/1980 | Mikovsky et al. | 208/143 |
| 4,194,964 | 3/1980 | Chen et al. | 208/108 |
| 4,202,758 | 5/1980 | O'Hara et al. | 208/143 |
| 4,371,728 | 2/1983 | Farha et al. | 208/143 |
| 4,413,153 | 11/1983 | Garwood et al. | 585/304 |
| 4,415,436 | 11/1983 | Angevine | 208/89 |
| 4,440,630 | 4/1984 | Oleck et al. | 208/111 |
| 4,497,968 | 2/1985 | Wright et al. | 585/304 |

*Primary Examiner*—Curtis R. Davis

*Attorney, Agent, or Firm*—Alexander J. McKillop; Charles J. Speciale; L. G. Wise

[57] ABSTRACT

A process and reactor system is disclosed for hydrotreating a low sulfur containing olefinic distillate and conventional feedstock to a catalytic hydrodesulfurization. The process comprises passing a minor portion of the olefinic distillate to a first hydrotreating zone in admixture with conventional CHD feedstock. A major portion of the olefinic distillate is passed to a second hydrotreating zone in combination with the effluent from the first zone. In this manner the exotherm attributable to olefins hydrogenation is controlled within limits sufficient to avoid very frequent catalyst regeneration.

6 Claims, 1 Drawing Sheet

PROCESS FOR HYDROTREATING OLEFINIC DISTILLATE

This invention relates to a process and means for hydrogenating olefinic distillate boiling range hydrocarbons. In particular, the invention relates to a process and means for combining the hydrogenation of distillate hydrocarbons produced by olefins oligomerization with catalytic hydro desulfurization of refinery hydrocarbon product streams.

BACKGROUND OF THE INVENTION

The feasibility and adaptability of the basic chemistry of zeolite catalyzed conversion of oxygenates and olefins to produce higher hydrocarbons has been the subject of much inventive research activity. Recent developments in zeolite catalyzed hydrocarbon conversion processes have created interest in using olefinic feedstocks for producing $C_5+$ gasoline, diesel fuel, etc. In addition to the basic work derived from ZSM-5 type zeolite catalyst, a number of discoveries have contributed to the development of a new industrial process, known as Mobil Olefins to Gasoline/Distillate ("MOGD"). This process has significance as a safe, environmentally acceptable technique for utilizing feedstocks that contain lower olefins, especially $C_2$–$C_5$ alkenes. Conversion of lower olefins to gasoline and/or distillate products is disclosed in U.S. Pat. No. 3,960,978 and 4,021,502 (Givens, Plank and Rosinski) wherein gaseous olefins in the range of ethylene to pentene, either alone or in admixture with paraffins, are converted into an olefinic gasoline blending stock by contacting the olefins with a catalyst bed made up of a ZSM-5 type zeolite. In a related manner, U.S. Pat. No. 4,150,062, 4,211,640 and 4,227,992 (Garwood, et al) disclose processes for converting olefins to gasoline and/or distillate components. The foregoing disclosures are incorporated herein by reference.

In the process for catalytic conversion of olefins to heavier hydrocarbons by catalytic oligomerization using a medium pore shape selective acid crystalline zeolite, such as ZSM-5 type catalyst, process conditions can be varied to favor the formation of either gasoline or distillate range products. At moderate temperature and relatively high pressure, the conversion conditions favor aliphatic distillate range product having a normal boiling point of at least 165° C. (330° F.). Lower olefinic feedstocks containing $C_2$–$C_8$ alkenes may be converted. The distillate product produced from olefins oligomerization represents an advantageous source for diesel fuel and the like; however, the oligomerization product contains olefinic unsaturation which must be hydrogenated to produce paraffins having a cetane value compatible with the intended product use. Rather than construct an independent hydrotreating operation for hydrogenating the MOGD product, if technically feasible, the use of existing hydrotreating operations is to be preferred. One such commonly available operation found in the refinery setting is catalytic hydrodesulfurization.

Catalytic hydrodesulfurization, or CHD, is a well-known process used to remove sulfur from sulfur-bearing fuel oils by hydrogenation to produce hydrogen sulfide. Typically, further hydroconversion of the feed is not realized in the CHD operation. Hydrocarbon feed materials which may be successfully desulfurized in the process include straight run hydrocarbons or hydrocarbon materials of cracking operations. Generally, the process is conducted at elevated temperatures between 260° C. and 400° C. and pressures between 3500 kPa and 21000 kPa. The process can use a wide range of hydrogenation catalysts including catalysts incorporating chromium, molybdenum, nickel, platinum, tungsten and the like, either alone or in mixtures, on supports such as silica or alumina.

It has been discovered that feeding a stream containing a significant quantity of olefinic materials, such as the product of an MOGD process, to an existing CHD unit in order to combine hydrodesulfurization of the usual feed to the CHD unit with hydrogenation of the MOGD product results in an excessive temperature rise in the unit which, in turn, results in a reduction in the CHD cycle and increase in the frequency of catalyst regeneration. The effect renders the process so combined uneconomic. The cause of the high temperature rise is the high exotherm of the olefin hydrogenation reaction. Accordingly, workers in the field have sought ways to moderate or otherwise manage this high exotherm so that the MOGD product may be combined with CHD feed to permit utilization of the CHD operation for the hydrotreating of olefinic MOGD product to produce a hydrogenated product having higher cetane number.

Accordingly, it is an object of the present invention to provide a process for the integration of MOGD product hydrotreating with CHD feed hydrotreating.

Another object of the present invention is to provide a process to convert the product of olefins oligomerization to distillate fuel having higher cetane number.

Yet another object of the present invention is to provide a unique reactor means effective for the combined hydrotreating of the typical feed to a CHD operation plus feeds containing highly exothermic unsaturation, such as the product of the MOGD olefins oligomerization process.

SUMMARY OF THE INVENTION

The surprising discovery has been made that an olefinic distillate product such as from an MOGD process can be hydrotreated in combination with the typical refinery feed to a catalytic hydrodesulfurization unit without experiencing excessive catalyst deactivation or increased cycle length by combining only a small portion of the MOGD feed with the CHD feed to a first hydrogenation zone at elevated temperature containing hydrotreating catalyst while a major portion of the MOGD feed at low temperature is fed to a second zone also containing hydrotreating catalyst. In this manner the exothermic olefins hydrogenation reaction temperature is controlled so as to reduce any deleterious effect thereof on catalyst activity and the reactions that contribute to catalyst deactivation. The effluent from the CHD operation is separated to recover a distillate product having a higher cetane number as well as products comprising desulfurized hydrocarbons.

The process is accomplished in a unique reactor system combining olefins oligomerization reactor means with reactor means containing two catalyst zones serially connected with means for feeding a feedstock at high temperature to a first hydrogenation zone and a second means for feeding a low temperature feed to a second zone in admixture with the effluent from the first hydrogenation zone.

More particularly, a process has been discovered for hydrogenation of olefinic-rich hydrocarbon feedstock, comprising:

(a) reacting a hydrocarbon mixture comprising a minor portion of said olefins-rich hydrocarbon feedstock and sulfur-containing liquid hydrocarbon in a first catalytic hydrodesulfurization zone in contact with catalyst particles at elevated temperature, said minor portion being in an amount sufficient to maintain said first zone hydrogenation exotherm under hydrodesulfurization and olefins hydrogenation conditions;

(b) passing step (a) reaction effluent stream to a second catalytic hydrodesulfurization zone containing catalyst particles under hydrodesulfurization and olefins hydrogenation conditions in admixture with a major portion of said olefins-rich hydrocarbon feedstock at low temperature;

(c) recovering hydrogenated desulfurized liquid hydrocarbons.

DETAIL DESCRIPTION OF THE INVENTION

Figure 1:
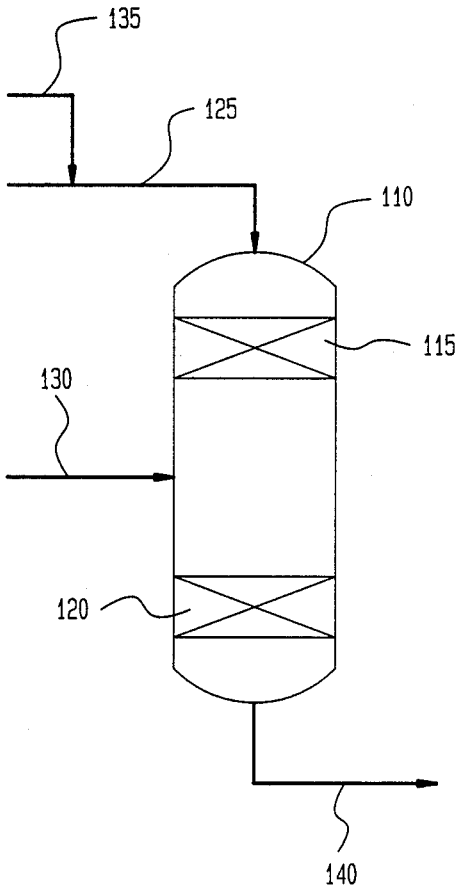
FIG. 1 is a schematic drawing of the novel reactor of the present invention.

The invention involves the integrated processing of the product stream from a Mobil Olefins to Gasoline/-Distillate (MOGD) process with the feedstream to a catalytic hydrodesulfurization reactor.

Virtually all petroleum crude oil and straight run fractions thereof contain one or more compounds of sulfur, nitrogen, heavy metals, halogen material and oxygen whose removal from the petroleum fractions is necessitated for reasons relating to refinery process operations, product quality or environmental considerations. Hydrogenation is one of the methods commonly used in the petroleum refining arts to affect the removal of many of these undesirable foreign elements. Sulfur is perhaps the most common of the contaminating elements in crude oil and is found in one form or another in almost all crude oils and straight run fractions. Desulfurization processes are conducted by hydrogenation in the presence of a catalyst whereby the sulfur impurities are converted to hydrogen sulfide. Hydrocarbon materials which may be successfully desulfurized include those referred to as straight run hydrocarbons or hydrocarbon materials of cracking operations including kerosene, gas oil, cycle stocks from catalytic cracking or thermal cracking operations, residual oils, thermal and coker distillates. Sulfur concentrations of these hydrocarbons may vary from about 0.05 to about 10 weight percent or higher. Heavy hydrocarbon stocks, i.e., having an API gravity greater than 20, may also be employed as feedstock to the hydrodesulfurization process.

Catalyst materials which may be successfully employed in the desulfurization of hydrocarbon materials include those catalysts known to have significant hydrogenation activity which promotes the conversion of sulfur to form hydrogen sulfide, which is thereafter removed separately from the desulfurized product of the process. Catalysts suitable for the purpose include, for example, siliceous catalyst including silica-alumina, platinum-alumina type catalyst, chromium type, molybdenum-trioxide, nickel-molybdate supported on alumina, nickel tungstate on alumina, cobalt-molybdate on alumina, and nickel-cobalt-molybdate catalysts. Other suitable classes of catalysts are those which have molybdenum, chromium, vanadium, and/or tungsten as an outer acid-forming element in combination with phosphorus, silicon, germanium and platinum as a central acid-forming element.

The hydrogen employed in catalytic hydrodesulfurization may be pure hydrogen or a hydrogen rich stream derived from a refinery process. Also, the hydrogen rich stream derived from the separation of catalytic hydrodesulfurization off-gasses may be recycled to the desulfurization unit.

U.S. Pat. No. 3,850,743 to Peiser et al., incorporated herein by reference, describes the operation of a catalytic hydrodesulfurization process.

In the MOGD process olefins are oligomerized to produce gasoline, distillate, LPG and lighter hydrocarbons. The oligomerization products are separated into an LPG and lighter stream, distillate stream, and gasoline stream. Operating details for typical MOGD units are disclosed in U.S. Pat. Nos. 4,456,779; 4,497,968 (Owen, et al.) and 4,433,185 (Tabak). These patents are incorporated herein by reference.

Referring to FIG. 1, one embodiment of the process and apparatus of the instant invention is illustrated. Vessel 110 is a catalytic hydrogenation reactor containing two separate catalytic beds 115 and 120. Hydrogenation catalyst particles typical of catalyst used in the CHD process is contained in each bed, which catalyst may be the same or different. In a preferred embodiment, two streams of hydrocarbons are fed to the reactor; one 125 from a top inlet and a second 130 to a mid-portion inlet to the reactor above catalyst bed 120, co-current with the 125 stream. Feedstream 125 comprises the main feedstream to the vessel containing the conventional CHD feedstock from straight run or cracked hydrocarbon streams, rich in sulfur-bearing hydrocarbons. Optionally, stream 125 may be mixed with a minor portion of the olefinic distillate product, (low sulfur, olefins-rich hydrocarbons) from an MOGD process or other process producing an olefins-rich stream in a ratio between 4:1 and 10:1. The stream is mixed with excess hydrogen 135 and passed to the first catalyst zone 115 at a temperature preferably between 260°–300° C. at start of cycle condition and a pressure between about 2800 kPa and 7000 kPa Under these conditions approximately 60–75% of the hydrogenation reaction is complete in the first bed.

Stream 130 containing the major portion of MOGD product stream rich in olefinic distillate hydrocarbons (olefins-rich) and low in sulfur content, i.e. preferably less than 2% sulfur or more preferably less than 1% sulfur, or a low sulfur containing hydrocarbon stream similarly rich in olefins, is introduced into vessel 110 at a temperature preferably between 38°–260° C. and mixed with the effluent stream from the first catalyst zone 115 above the second zone 120. Second zone conditions comprise temperature between 260° and 400° C. and pressure between 2800 and 7000 kPa. Hydrogenation of stream 130 occurs in catalyst bed 120 at a temperature rise of between 10°–40° C. across the bed. In this manner, high temperatures ordinarily derived from the strong olefin hydrogenation exotherm are avoided with beneficial results for catalyst life and cycle length. The product is recovered from the reactor through conduit 140, preferably at a temperature between about 340° and 410° C. The product is separated by fractionation techniques known in the art to produce a product stream of distillate boiling range hydrocarbons of improved cetane number useful as diesel fuel.

While the invention has been described by reference to specific method and means for practicing the invention, there is no intent to limit the scope of the invention except as described in the following claims.

What is claimed is:

1. A process for hydrogenation of low sulfur containing olefins-rich hydrocarbon feedstock, comprising:

(a) reacting a hydrocarbon mixture comprising a minor portion of said olefins-rich hydrocarbon feedstock and sulfur-containing liquid hydrocarbon in a first catalytic hydrodesulfurization zone in contact with catalyst particles at a temperature between 260° and 400° C. and pressure between 2800 kPa and 7000 kPa, said minor portion being in an amount sufficient to maintain said first zone hydrogenation exotherm under hydrodesulfurization and olefins hydrogenation conditions whereby catalyst deactivation is reduced;

(b) passing step (a) reaction effluent stream to a second catalytic hydrodesulfurization one containing catalyst particles under hydrodesulfurization and olefins hydrogenation conditions at a temperature between 260° and 400° C. and pressure between 2800 kPa and 7000 kPa in admixture with a major portion of said olefins-rich hydrocarbon feedstock at low temperature;

(c) recovering hydrogenated desulfurized liquid hydrocarbons.

2. The process of claim 1 wherein said olefins-rich hydrocarbon feedstock comprises oligomerized olefinic hydrocarbon distillate and step (c) liquid hydrocarbons contain hydrogenated distillate.

3. The process of claim 1 wherein the ratio of step (a) sulfur containing hydrocarbon feedstream to olefins-rich hydrocarbon feedstock in said mixture is about 4:1 to 10:1.

4. The process of claim 1 wherein said olefins-rich hydrocarbon feedstock is fed to said second zone at a temperature between about 38° and 260° C. and the temperature rise across the zone is between 10°–14° C.

5. The process according to claim 1 wherein said olefins-rich hydrocarbon feedstock comprises olefinic distillate product from olefins oligomerization process consisting essentially of $C_{10}$–$C_{20}$ olefins.

6. The process according to claim 1 wherein said catalytic hydrodesulfurization feedstream comprises straight run hydrocarbons, gas oil, cracking stocks, residual oil and the like.

* * * * *